US007282669B2

(12) United States Patent
Tatematsu et al.

(10) Patent No.: US 7,282,669 B2
(45) Date of Patent: Oct. 16, 2007

(54) CERAMIC HEATER AND METHOD FOR MANUFACTURING THE SAME

(75) Inventors: Kazuho Tatematsu, Aichi (JP); Masahiro Konishi, Aichi (JP); Takeshi Yamaguchi, Aichi (JP)

(73) Assignee: NGK Spark Plug CC., Ltd., Aichi (JP)

( * ) Notice: Subject to any disclaimer, the term of this patent is extended or adjusted under 35 U.S.C. 154(b) by 520 days.

(21) Appl. No.: 10/207,088

(22) Filed: Jul. 30, 2002

(65) Prior Publication Data

US 2003/0029856 A1 Feb. 13, 2003

(30) Foreign Application Priority Data

Jul. 30, 2001 (JP) ..... 2001-229215

(51) Int. Cl.
*F23Q 7/22* (2006.01)
*H05B 3/44* (2006.01)

(52) U.S. Cl. ..... 219/270; 219/544

(58) Field of Classification Search ..... 219/270, 219/444.1, 544, 552, 553; 428/469, 472, 428/212, 446, 450; 174/255; 123/145 A
See application file for complete search history.

(56) References Cited

U.S. PATENT DOCUMENTS 5,233,166 A * 8/1993 Maeda et al. ..... 219/552
5,756,215 A * 5/1998 Sawamura et al. ..... 428/446
5,908,799 A * 6/1999 Kobayashi et al. ..... 501/98.4
6,254,974 B1 * 7/2001 Hanzawa et al. ..... 428/212
6,359,261 B1 3/2002 Watanabe et al.
6,507,006 B1 * 1/2003 Hiramatsu et al. ..... 219/444.1
6,599,457 B2 7/2003 Watanabe et al.
6,599,637 B1 * 7/2003 Itoh et al. ..... 428/472
6,613,443 B2 * 9/2003 Komatsu et al. ..... 428/469
6,744,016 B2 * 6/2004 Watanabe et al. ..... 219/270
2001/0054610 A1 * 12/2001 Watanabe et al. ..... 219/544
2002/0084103 A1 * 7/2002 Komatsu et al. ..... 174/255

FOREIGN PATENT DOCUMENTS

JP 2000-193241 7/2000
JP 2001-130967 5/2001

* cited by examiner

*Primary Examiner*—Daniel Robinson
(74) *Attorney, Agent, or Firm*—Sughrue Mion, PLLC

(57) ABSTRACT

A ceramic heater 1 includes a silicon nitride ceramic substrate 13 and a resistance-heating member 10 embedded in the silicon nitride ceramic substrate 13 . The silicon nitride ceramic substrate 13 contains oxygen derived from a sintering aid at an average concentration of 0.4–3.2% by weight in a surface layer portion extending from the surface thereof to a depth of 1 mm. The ceramic heater 1 can be manufactured by firing through hot pressing. A firing jig for use in a firing process has an SiC—C composite layer which is formed therein along the surface of cavities thereof while having a predetermined depth as measured from the cavity surface.

12 Claims, 7 Drawing Sheets

CERAMIC HEATER AND METHOD FOR MANUFACTURING THE SAME

BACKGROUND OF THE INVENTION

1. Field of the Invention

The present invention relates to a ceramic heater for use in, for example, a glow plug, and to a method for manufacturing the same.

2. Description of the Related Art

A conventionally known ceramic heater for use in, for example, a ceramic glow plug is configured such that a resistance-heating member formed of a conductive ceramic material or a like material is embedded in an electrically insulative ceramic substrate. A ceramic substrate formed of silicon nitride ceramic is widely used, by virtue of its excellent thermal shock resistance and high-temperature strength.

In the course of manufacture of a ceramic heater using the above-mentioned ceramic substrate, in many cases, a green body which is to become a ceramic substrate, is fired in order to enhance mechanical strength. However, in some cases of normal firing, differences in thermal expansion coefficient and sintering properties between silicon nitride ceramic and a conductive ceramic material raise a problem such as cracking in a boundary portion between the materials. Therefore, firing through hot pressing, which is conducted under a predetermined pressure, is often employed.

Firing through hot pressing employs a carbon jig for applying pressure to the above-mentioned green body with a parting agent such as BN present therebetween. A problem arises in this firing process, since silicon contained in silicon nitride ceramic and carbon contained in the carbon jig react with each other to produce silicon carbide. For example, since firing is performed in a reducing atmosphere induced by carbon, an oxide used as a sintering aid for silicon nitride tends to move toward the surface of silicon nitride ceramic in the course of firing. Therefore, in some cases, an uneven composition arises, thereby causing partial impairment in strength. In the case where a rare-earth oxide is used as a sintering aid, the melilite crystal phase is apt to be generated from firing in the ceramic substrate. In some cases, the melilite crystal phase induces low-temperature oxidation at around 1000° C., leading to cracking in the ceramic substrate (ceramic heater).

Further, silicon contained in silicon nitride and carbon contained in the carbon jig react with each other to produce silicon carbide, thereby raising the following problem. For example, defective firing of the surface of silicon nitride ceramic may occur, thereby causing impairment in strength. Also, the reaction of silicon nitride and carbon in the course of firing may induce bonding between silicon nitride ceramic and the carbon jig, which have different thermal expansion coefficients; thus, in subsequent cooling, the bonding may cause cracking in the carbon jig. Additionally, the carbon jig is apt to ablate through oxidation, thereby shortening the life thereof.

SUMMARY OF THE INVENTION

It is therefore an object of the present invention is to provide a ceramic heater exhibiting excellent mechanical strength and durability and to provide a method for manufacturing the same.

In order to achieve the above object, the present invention provides a ceramic heater comprising a silicon nitride ceramic substrate and a resistance-heating member embedded in the silicon nitride ceramic substrate, characterized in that the silicon nitride ceramic substrate contains oxygen at an average concentration of 0.4–3.2% by weight in a surface layer portion extending from a surface thereof to a depth of 1 mm.

According to the above-described configuration, the oxygen concentration of a surface layer portion of the ceramic substrate is 0.4–3.2% by weight; therefore, the ceramic substrate is not prone to partial impairment in strength, which would otherwise result from uneven composition of the surface layer portion. When the oxygen concentration is less than 0.4% by weight, silicon nitride density may be impaired in the surface layer portion, potentially causing a failure to provide sufficient strength. Also, when the oxygen concentration exceeds 3.2% by weight, sufficient strength may fail to be obtained. Preferably, the oxygen concentration is 0.6–2.0% by weight.

In the case of a ceramic substrate which contains a rare-earth component, when substantially no melilite crystal phase is present or when the melilite crystal phase is present in an amount not greater than 1% by weight, a problem related to melilite crystal phase such as low-temperature oxidation is unlikely to arise, thereby leading to enhancement of mechanical strength of the ceramic heater. Notably, melilite crystal is a crystal of a compound represented by the general formula $R_2Si_3N_4O_3$, wherein R is a rare-earth element.

The above-mentioned ceramic heater can be manufactured by the following method of the present invention. The present invention provides a method for manufacturing a ceramic heater comprising a silicon nitride ceramic substrate and a resistance-heating member embedded in the silicon nitride ceramic substrate, characterized by comprising a step for firing a green body or a preliminarily fired body which is to become the silicon nitride ceramic substrate, through hot pressing by use of a firing jig; and characterized in that the firing jig has a plurality of curved cavities for accommodating the green bodies or preliminarily fired bodies and contains silicon carbide in a surface layer portion extending from the surface of the cavities to a depth of at least 0.5 mm. Notably, the expression "a surface layer portion extending from the surface of the cavities to a depth of 0.5 mm" means a curved region having a depth of 0.5 mm as measured along the curved surface of the cavities, and does not mean a region having a depth of 0.5 mm as measured along the thickness direction of the jig.

Since the firing jig contains silicon carbide in a surface layer portion extending from the surface of the cavities to a depth of at least 0.5 mm, in the course of firing through hot pressing by use of the firing jig, silicon contained in a green body or a preliminarily fired body which is to become a silicon nitride ceramic substrate is unlikely to react with a component of the firing jig (specifically carbon contained in the firing jig), thereby preventing or suppressing impairment in strength, which would otherwise result from defective firing of a surface layer portion of the silicon nitride ceramic substrate. The silicon nitride ceramic substrate and the firing jig are unlikely to react with each other and thus are unlikely to bond together, thereby preventing cracking or a like defect in the jig, which would otherwise result from difference in thermal expansion coefficient therebetween in the course of cooling subsequent to firing. Since the firing jig is unlikely to become oxidized, the life of the firing jig is extended. According to the present invention, in order to manufacture a plurality of ceramic heaters in a single cycle of firing through hot pressing, the firing jig has a plurality of curved cavities formed on one side thereof for accommodating and transmitting pressure to green bodies or preliminarily fired bodies which are to become silicon nitride ceramic substrates; i.e., one side of the firing jig is substantially formed into alternating ridges and grooves (a corrugated shape). Since the cavities are curved, a large contact area is established between the cavities and the green bodies or preliminarily fired bodies which are to become silicon nitride ceramic substrates, whereby even pressure can be applied to the green bodies or preliminarily fired bodies. Further, since a surface layer portion of the firing jig extending from the surface of the cavities to a depth of at least 0.5 mm contains a predominant amount of silicon carbide, a reaction between a component of the jig and silicon contained in the green bodies or preliminarily fired bodies can be suppressed more effectively .

The green body or a preliminarily fired body which is to become a silicon nitride ceramic substrate may contain a sintering aid. In this case, since the present invention uses, in firing through hot pressing, a firing jig whose surface layer portion contains silicon carbide, reduction by carbon during firing is weakened as compared with the case of using, for example, a carbon jig formed essentially of carbon. Therefore, the method of the present invention can prevent or suppress, for example, uneven distribution of sintering aid components, which would otherwise result from migration of a sintering aid such as an oxide (rare-earth oxide) to a surface layer portion, whereby uneven composition or a like problem becomes unlikely to arise in the ceramic substrate, thereby preventing or suppressing impairment in mechanical strength.

By using the above-described firing jig, the method for manufacturing a ceramic heater of the present invention yields the following advantages: by virtue of a plurality of cavities, productivity and durability of the firing jig are enhanced; and in spite of a large contact area between the firing jig and green bodies or preliminarily fired bodies which are to become ceramic substrates, reaction therebetween becomes unlikely, whereby product ceramic heaters are unlikely to suffer impaired mechanical strength or a like problem.

The above-described firing jig can be obtained in the following manner. Specifically, a carbon jig having the plurality of cavities and formed essentially of carbon is used as the firing jig, and a surface layer portion of the carbon jig extending from a surface of the cavities to a depth of at least 0.5 mm is made of silicon carbide produced through a process of placing in each of the cavities a green body or preliminarily fired body formed essentially of a silicon compound or silicon, followed by firing through hot pressing at a temperature not lower than 1300° C. (and not higher than about 2300° C.). Alternatively, a carbon jig having the plurality of cavities and formed essentially of carbon is used as the firing jig, and a surface layer portion of the carbon jig extending from a surface of the cavities to a depth of at least 0.5 mm is made of silicon carbide produced through a process of applying a composition consisting essentially of a silicon compound or silicon to at least a surface of the cavities or by coating at least the surface with the composition, followed by heating at a temperature of not lower than 1500° C. (and not higher than about 2300° C.).

Preferably, the surface layer portion in which silicon carbide is formed is formed essentially of silicon carbide. The expression "formed essentially of silicon carbide" means that silicon carbide is contained in the largest amount among components of the surface layer portion. For example, the surface layer portion can be an SiC—C composite layer that contains silicon carbide and carbon at a ratio of 6:4 by weight. The firing jig can be an SiC jig that is formed of only silicon carbide. However, in view of price and other factors, a jig having an SiC—C composite layer is preferred as the firing jig. The firing jig used in the present invention must contain silicon carbide in a surface layer portion extending from the surface thereof to a depth of at least 0.5 mm. Needless to say, the depth can be greater than 0.5 mm. However, when the depth is less than 0.5 mm, the above-described effect of the present invention may fail to be sufficiently exhibited.

Further, the silicon nitride ceramic substrate of the ceramic heater of the present invention assumes a microstructure, for example, such that grains of the $Si_3N_4$ phase containing $Si_3N_4$ as a main component are bonded by means of a grain boundary phase (bonding phase) derived from a sintering aid component. The sintering aid component essentially constitutes the bonding phase, but may be partially incorporated into the main phase ($Si_3N_4$ phase). The bonding phase may contain unavoidable impurities; for example, silicon oxide contained in silicon nitride material powder, in addition to an intentionally added component serving as a sintering aid.

The sintering aid component for use in the present invention is not limited to a rare-earth component. For example, elements of Groups 4A, 5A, 3B, and 4B of the Periodic Table, such as Si and Al, can be used to such an extent as not to impair the effect of the present invention. These sintering aid candidates can be added in the form of oxides in the material preparation stage. Rare-earth components for use in the present invention are Sc, Y, La, Ce, Pr, Nd, Sm, Eu, Gd, Tb, Dy, Ho, Er, Tm, Yb, and Lu. In particular, Tb, Dy, Ho, Er, Tm, and Yb can be favorably used, since these elements, when added, accelerate crystallization of the grain boundary phase and enhance high-temperature strength.

DETAILED DESCRIPTION OF THE PREFERRED EMBODIMENTS

The invention is now explained in greater detail by reference to the drawings. However, the present invention should not be construed as being limited thereto.

Figure 1:
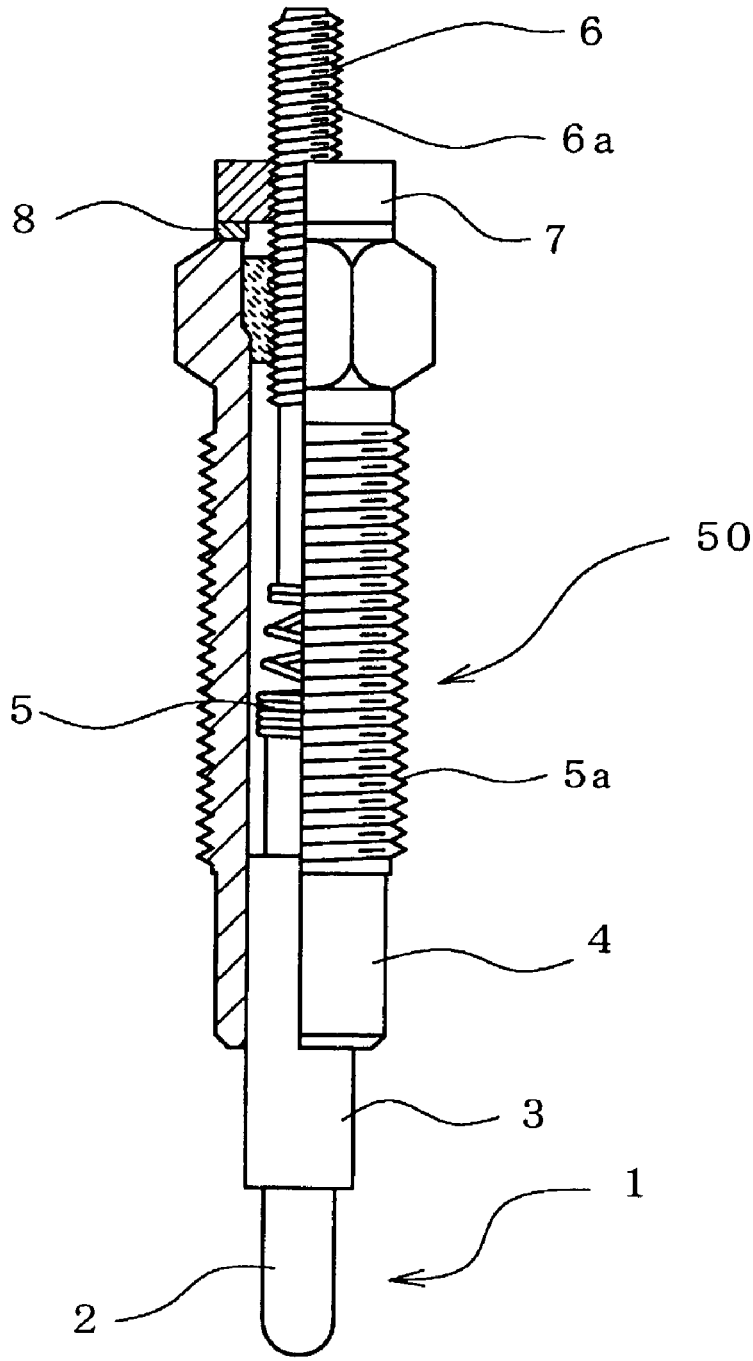
FIG. 1 is an elevational, partially sectional view showing an embodiment of a glow plug employing a ceramic heater according to the present invention.

FIG. 1 shows a glow plug using a ceramic heater manufactured by a method of the present invention while an internal structure thereof is partially exposed. A glow plug 50 includes a ceramic heater 1 disposed at one end thereof; a metal sleeve 3 which covers the ceramic heater 1 such that an end portion 2 of the ceramic heater 1 projects from the metal sleeve 3; and a cylindrical metal housing 4 which covers the sleeve 3. The ceramic heater 1 and the sleeve 3 are brazed together, whereas the sleeve 3 and the metal housing 4 are brazed together.

One end portion of a connection member 5 is fitted to a rear end portion of the ceramic heater 1. The connection member 5 is formed of a metal wire such that opposite end portions thereof are each formed into the shape of a helical spring. The other end portion of the connection member 5 is fitted to a corresponding end portion of a metal shaft 6 inserted into the metal housing 4. A rear portion of the metal shaft 6 extends to the exterior of the metal housing 4 and is formed into an external thread portion 6*a*. A nut 7 is engaged with the external thread portion 6*a* and is tightened toward the metal housing 4 to thereby fixedly attach the metal shaft 6 to the metal housing 4. An insulation bush 8 is interposed between the nut 7 and the metal housing 4. An external thread portion 5*a* is formed on the external surface of the metal housing 4 and is adapted to fixedly attach the glow plug 50 to an unillustrated engine block.

Figure 2:
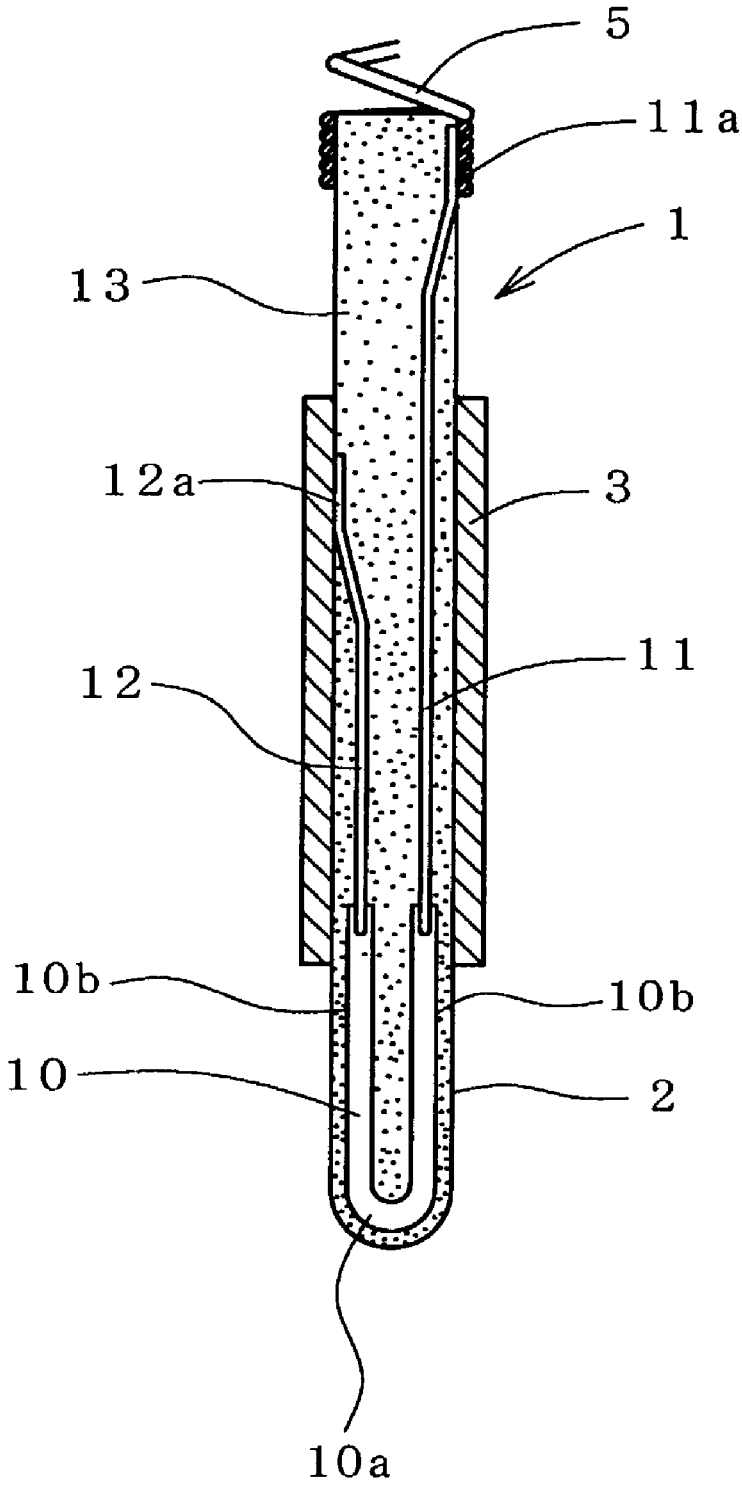
FIG. 2 is an elevational, sectional view of the ceramic heater of FIG. 1.

As shown in FIG. 2, the ceramic heater 1 includes a U-shaped ceramic resistance-heating member (hereinafter, also called a heating member) 10. End portions of wire-like or rod-like electrodes 11 and 12 are embedded in corresponding end portions of the heating member 10. The heating member 10 and the electrodes 11 and 12 are entirely embedded in a rod-like silicon nitride ceramic substrate 13 having a circular cross section. The heating member 10 is disposed such that a direction-changing portion 10*a* is located at an end portion of the ceramic substrate 13, and straight portions 10 *b* extend from the corresponding ends of the direction-changing portion 10*a*.

Material for the ceramic substrate 13 is prepared, for example, by adding a sintering aid powder, such as an $Er_2O_3$ powder, a $Yb_2O_3$ powder, or $SiO_2$ powder, to a $Si_3N_4$ powder in an amount of 3–15% by weight. The resulting mixture is formed into a green body, which is then sintered to obtain the ceramic substrate 13. A surface layer portion of the ceramic substrate 13 extending from the surface thereof to a depth of 0.1 mm has an average oxygen concentration of 0.4–3.2% by weight. The oxygen concentration of the surface layer portion was measured in the following manner. The surface layer portion extending from the surface of the ceramic substrate 13 to a depth of 1.0 mm was shaved off and then pulverized. The resultant powder was measured for oxygen concentration by a nondispersive infrared absorption process. Material for the heating member 10 is prepared, for example, by the steps of mixing $Si_3N_4$ powder and WC or $MoSi_2$ powder, which is a conductive ceramic powder; and adding to the mixture a sintering aid powder similar to that used for the ceramic substrate 13, in an amount of 0.8–10.5% by weight. The resulting mixture is formed into a green body, which is then sintered to obtain the heating member 10. The sintered body has a microstructure such that WC or $MoSi_2$ grains are dispersed in an $Si_3N_4$ matrix (matrix ceramic phase). The electrodes 11 and 12 are made of a metal wire of, for example, W, W—Re, Mo, Pt, Nb, Ta, or NICHROME.

In FIG. 2, a thin metal layer (not shown) of, for example, nickel is formed, by a predetermined method (for example, plating or vapor deposition process), on the surface of the ceramic substrate 13 in a region including an exposed portion 12*a* of the electrode 12. The sleeve 3 is brazed to the thin metal layer to thereby be fixedly attached to the ceramic substrate 13 and electrically connected to the electrode 12. Similarly, a thin metal layer is formed on the surface of the ceramic substrate 13 in a region including an exposed portion 11*a* of the electrode 11. The connection member 5 is brazed to the thin metal layer. Thus, power is supplied from an unillustrated power supply to the heating member 10 via the metal shaft 6 (FIG. 1), the connection member 5, and the electrode 11. The heating member 10 is grounded via the electrode 12, the sleeve 3, the metal housing 4 (FIG. 1), and an unillustrated engine block.

Figure 3:
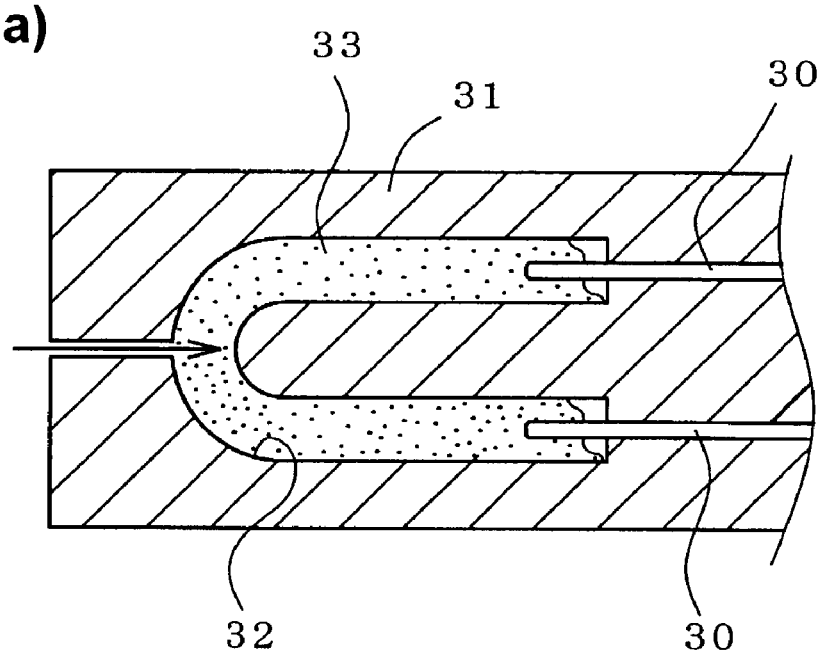
FIGS. 3(*a*) and (*b*) are explanatory views showing a step of manufacturing a ceramic heater.
Figure 3:
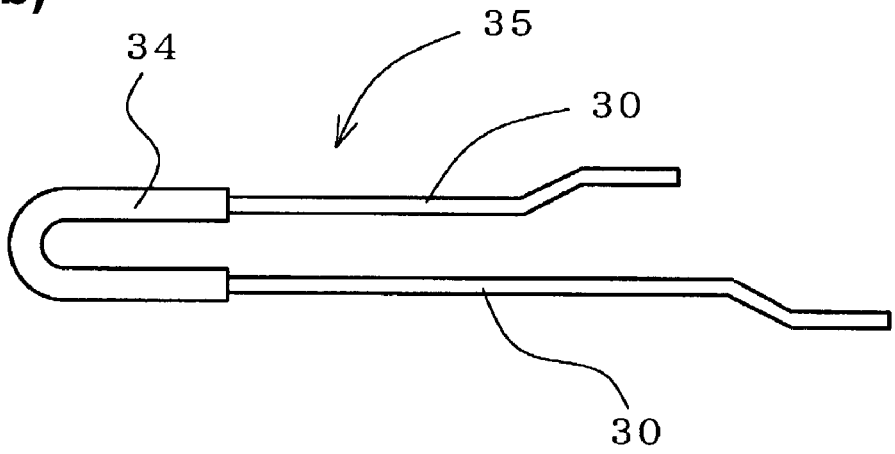

A method for manufacturing the ceramic heater 1 will next be described. First, as shown FIG. 3(*a*), electrode materials 30 are disposed in a mold 31 having a U-shaped cavity 32, which corresponds to the heating member 10, such that respective end portions are inserted into the cavity 32. A compound 33 is injected into the cavity 32. The compound 33 is prepared by the steps of wet-mixing 45% by weight insulative component material, which is composed of 85% by weight powder containing $Si_3N_4$ as a main component and 15% by weight sintering aid powder (e.g., a powder mixture of 10% by weight $Yb_2O_3$ and 5% by weight $SiO_2$), and 55% by weight WC powder (or $MoSi_2$ powder) for 24 hours, followed by drying; and mixing the resultant powder mixture and a binder (an organic binding agent). As shown in FIG. 3(*b*), the electrode materials 30 and a U-shaped heating-member green body 34 are integrated into a unitary green body 35. The heating-member green body 34 is formed such that the cross section thereof assumes a substantially circular shape, and in such a manner as to be composed of a direction-changing portion 34*a* and straight portions 34*b* (see FIG. 4(*a*)).

Figure 4:
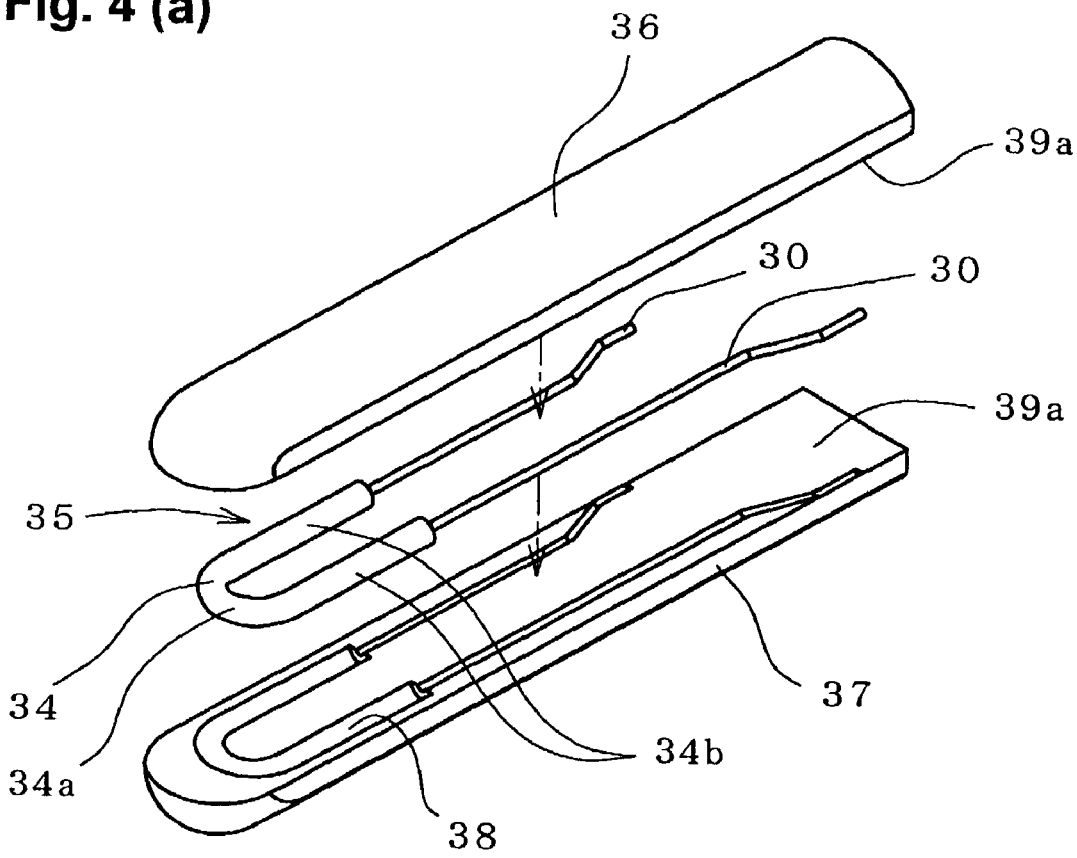
FIGS. 4(*a*) and (*b*) are explanatory views showing a step subsequent to the step of FIG. 3.
Figure 4:
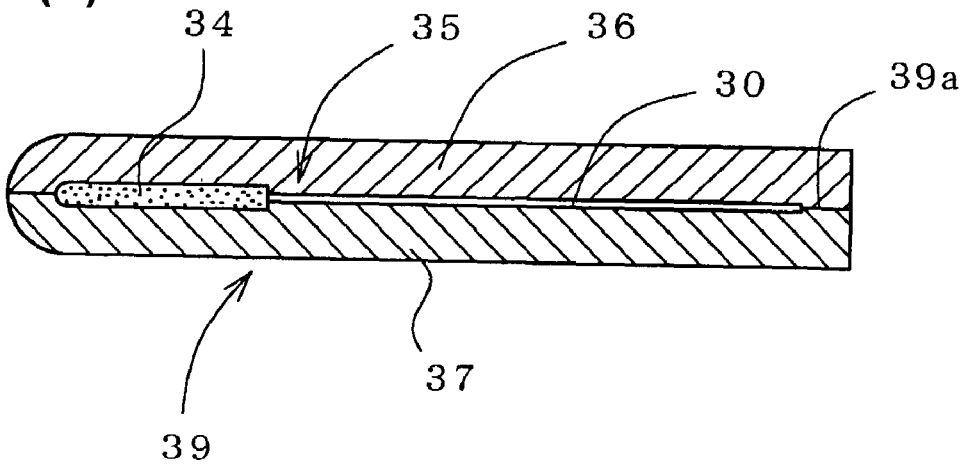

A material powder for the ceramic substrate 13 is die-pressed into half green bodies 36 and 37 shown in FIG. 4(*a*). Specifically, for example, to 83% by weight silicon nitride powder, 10% by weight $Yb_2O_3$ powder, 5% by weight $SiO_2$ powder, and 2% by weight $MoSi_2$ powder, which serve as sintering aids, are added to thereby obtain a material powder. The material powder and a binder are wet-mixed for 20 hours. The resulting mixture is granulated through spray-drying. Resultant granules are compacted into the two half green bodies 36 and 37.

Figure 5:
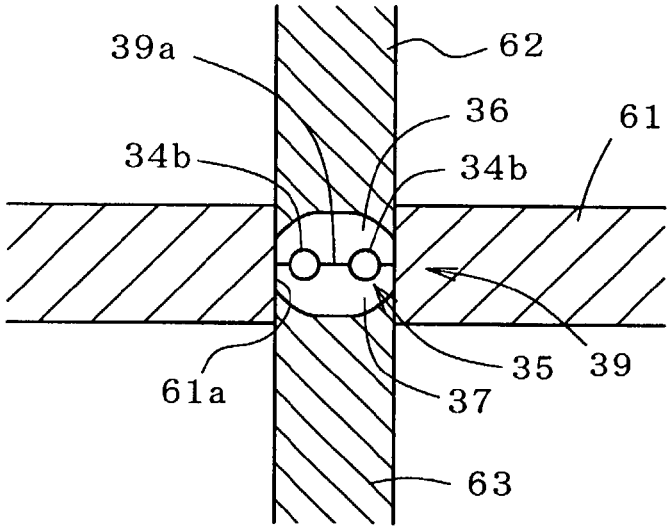
FIGS. 5(*a*) and (*b*) are explanatory views showing a step subsequent to the step of FIG. 4.
Figure 5:
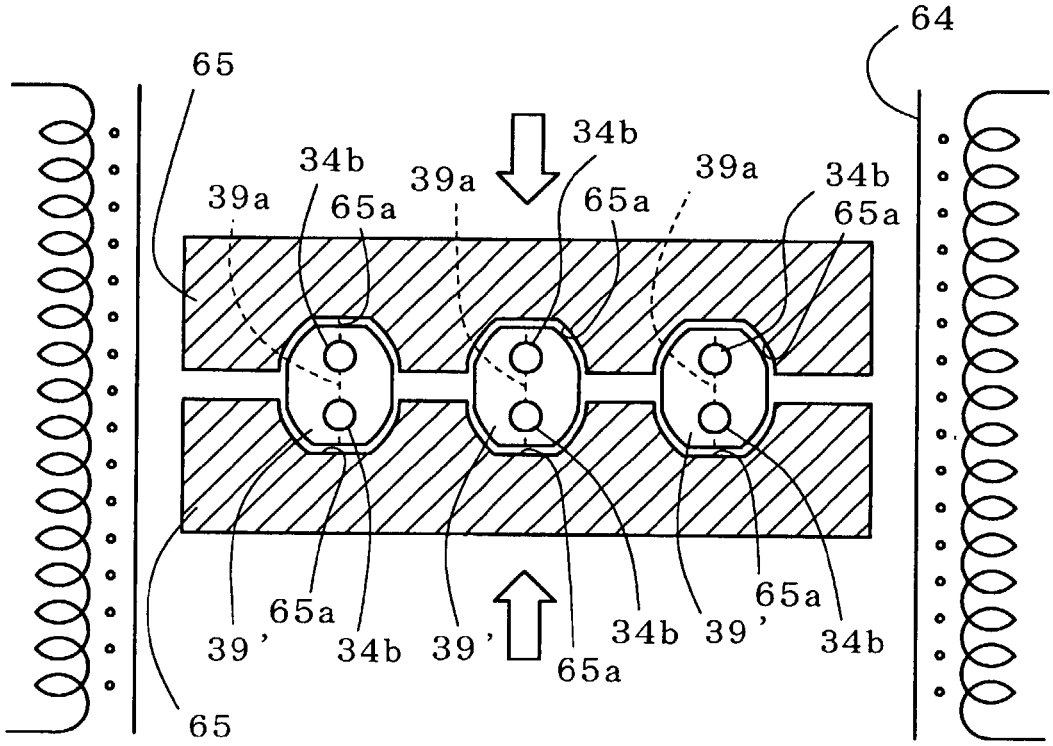
Figure 6:
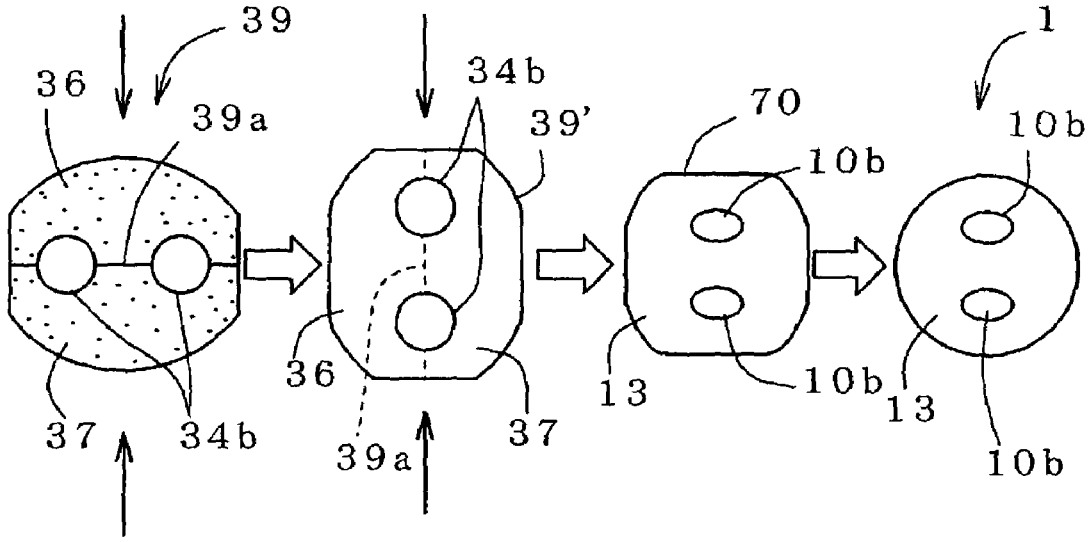
FIGS. 6(*a*)–(*d*) are schematic views showing a change in the cross-sectional shape of a composite green body and that of a sintered body.

A depression 38 having a shape corresponding to the unitary green body 35 is formed on a mating surface 39*a* of each of the half green bodies 36 and 37. Next, the half green bodies 36 and 37 are joined together at the mating surfaces 39*a*, while the unitary green body 35 is accommodated in the depressions 38 (see FIG. 4 *b*)). Then, as shown in FIG. 5(*a*), an assembly of the half green bodies 36 and 37 and the unitary green body 35 is placed in a cavity 61*a* of a die 61 and is then pressed by means of punches 62 and 63, thereby obtaining a composite green body 39 as shown in FIG. 6(*a*). The pressing direction is substantially perpendicular to the mating surfaces 39*a* of the half green bodies 36 and 37.

In order to remove a binder component and the like contained in the material powder, the thus-obtained composite green body 39 is subjected preliminary firing at a predetermined temperature (e.g., about 600° C.) to thereby become a preliminarily fired body 39' (a preliminarily fired body can be considered as a composite green body in the broad sense) shown in FIG. 6(*b*). Subsequently, as shown in FIG. 5(*b*), the preliminarily fired body 39' is placed in cavities 65*a* of hot-pressing dies (firing jigs) 65. In the hot-pressing dies (firing jigs) 65, a surface layer portion extending from the surface of the cavities 65*a* to a depth of at least 0.5 mm assumes the form of an SiC—C composite layer formed essentially of silicon carbide (i.e., the surface layer portion contains a predominant amount of silicon carbide). In each of the hot-pressing dies (firing jigs) 65, a plurality of curved cavities 65*a* are formed on one side thereof, whereby a plurality of fired bodies can be manufactured in a single cycle of hot pressing.

Figure 8:
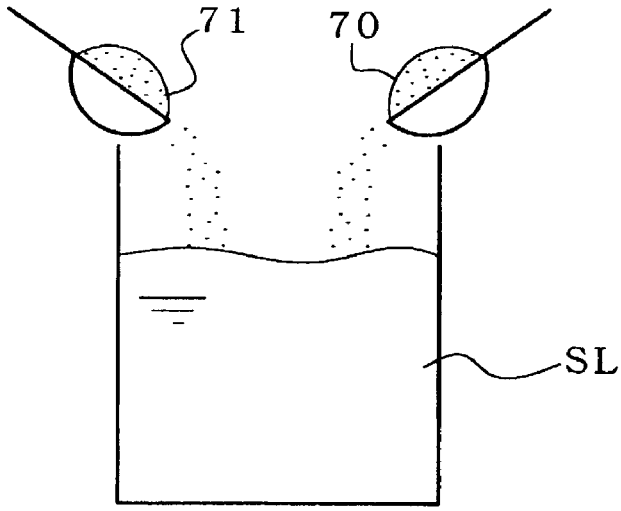
FIGS. 8(*a*)–(*c*) are explanatory views showing typical steps, together with a modified step, in an embodiment of a method for manufacturing a ceramic heater according to the present invention.
Figure 8:
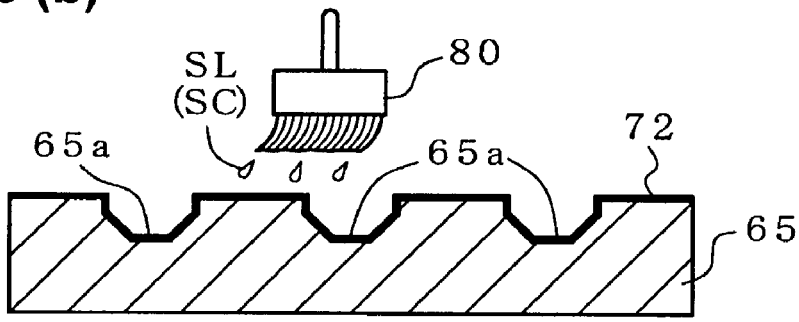
Figure 8:
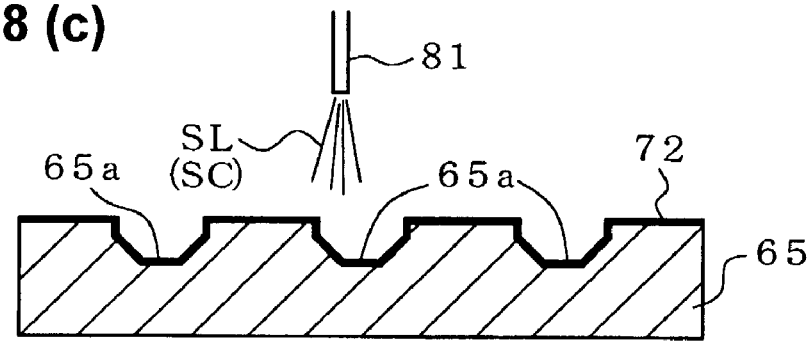

A parting agent is applied to the surface of the cavities 65*a*. For example, as shown in FIG. 8(*a*), parting material powder 70 (e.g., fine powder of boron nitride (BN)) and alumina powder 71, together with a dispersant, are placed in a solvent (e.g., ethanol) to thereby prepare a coating suspension SL. The coating suspension SL is manually applied to the cavity surface by means of a brush 80 or the like as shown in FIG. 8(*b*) or sprayed on the cavity surface by means of a spray nozzle 81 as shown in FIG. 8(*c*). Subsequently, the solvent is allowed to evaporate for drying, thereby forming a composite coating layer 72 made from the parting material powder 70 and the alumina powder 71. Notably, the composite coating layer 72 may be applied onto the external surface of the preliminarily fired body 39' as well.

As shown in FIG. 5(*b*), the preliminarily fired bodies 39' are placed in a kiln 64 while being held between the hot-pressing dies 65, which are coated with the composite coating layer 72 as mentioned above. In the kiln 64, the preliminarily fired bodies 39' are fired at a predetermined temperature of not lower than 1700° C.(e.g., about 1800° C.) while being pressed between the hot-pressing dies 65, to thereby become sintered bodies 70 as shown in FIG. 6(*c*). The heating-member green body 34 shown in FIG. 4(*b*) is sintered into the heating member 10, and the half green bodies 36 and 37 shown in FIG. 4(*b*) are sintered into the ceramic substrate 13. The electrode materials 30 become the electrodes 11 and 12. The firing condition can be established, for example, in the following manner: nitrogen of atmospheric pressure that contains impurity oxygen at a partial pressure of 0.01–100 Pa is introduced and then heated to a firing temperature (e.g., 1800° C.), to thereby establish the firing atmosphere, which is maintained for firing.

In firing mentioned above, as shown in FIG. 6(*b*), the preliminarily fired body 39' is fired while being compressed in the direction parallel with the mating surfaces 39*a* of the half green bodies 36 and 37, to thereby be formed into the sintered body 70. As shown in view FIG. 6(*c*), the straight portions 34*b* (see FIG. 4) of the heating-member green body 34 are deformed such that the circular cross section thereof is squeezed in the above-mentioned direction of compression, to thereby become the straight portions 10*b* of the heating member 10, which straight portions 10*b* have an elliptic cross section. As shown in FIG. 6(*d*), the external surface of the thus-obtained sintered body 70 is, for example, polished such that the cross section of the ceramic substrate 13 assumes a circular shape, thereby yielding the final ceramic heater 1.

Figure 7:
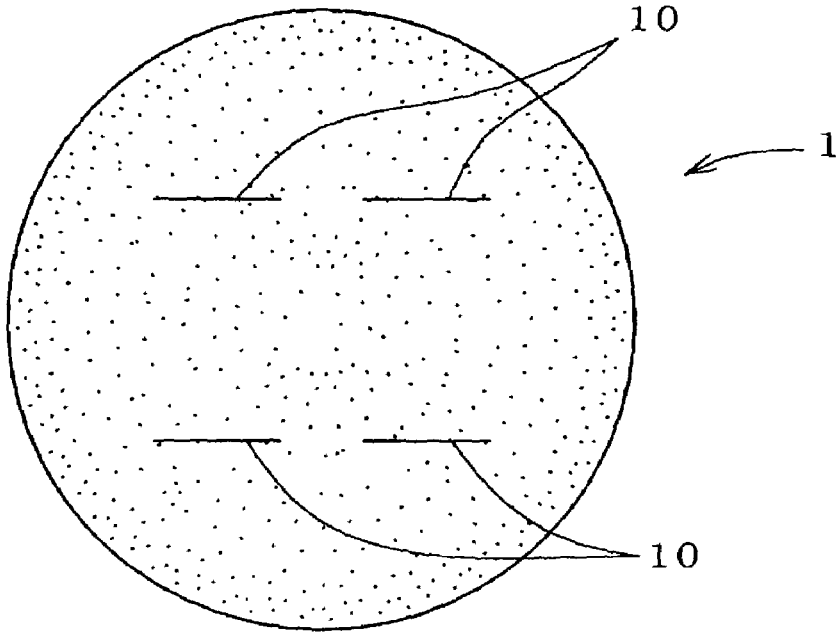
FIG. 7 is a sectional view showing another embodiment of the ceramic heater of the present invention.

As shown in FIG. 7, a paste of a conductive ceramic powder may be pattern-printed on a green body of a ceramic substrate in the form of a heating member. Subsequently, the green body is fired to thereby sinter the patterned material into the resistance-heating member 10. Alternatively, the resistance-heating member 10 may be formed of a metal having a high melting point, such as W or W—Re.

A method for manufacturing the hot-pressing dies (firing jigs) 65 to be used in the present embodiment will be described. The hot-pressing dies (firing jig) 65 can be manufactured by, for example, two kinds of methods. According to one method, carbon jigs each having a plurality of curved cavities and formed essentially of carbon (graphite) are formed into the hot-pressing dies (firing jigs) 65 by placing in the corresponding cavities green bodies or preliminarily fired bodies formed essentially of a silicon compound (silicon nitride or the like) or silicon, followed by firing through hot pressing at a temperature not lower than 1300° C. in a nonoxidizing atmosphere (e.g., in the $N_2$ atmosphere or under vacuum), to thereby form silicon carbide in a surface layer portion of each carbon jig extending from the surface of the cavities to a depth of at least 0.5 mm. According to the other method, carbon jigs each having a plurality of curved cavities and formed essentially of carbon (graphite) are formed into the hot-pressing dies (firing jigs) 65 by applying a composition (SC) consisting essentially of a silicon compound (silicon nitride or the like) or silicon to the surface of the carbon jigs (including the surface of the cavities) or by coating the surface with the composition, as in the case of the suspension SL to be applied or coated shown in FIG. 8(*b*) or 8(*c*), followed by heating at a temperature not lower than 1500° C. in a nonoxidizing atmosphere (e.g., in the $N_2$ atmosphere or under vacuum), to thereby form silicon carbide in a surface layer portion of each carbon jig extending from the surface of the cavities to a depth of at least 0.5 mm. In either method, a layer containing silicon carbide is evenly formed along the surface of the cavities 65*a* as deep as 0.5 mm, thereby preventing or suppressing reaction between the preliminarily fired bodies 39' and the firing jigs, or a like problem.

The presence and range (thickness) of the above-described layer containing silicon carbide and formed inward along the surface of the cavities 65*a* can be identified by EPMA. Specifically, the hot-pressing dies (firing jigs) 65 are cut along the direction of thickness, and then the cut surfaces thereof are polished. The polished surfaces are subjected to EPMA for distribution of elements. Intensity mapping of characteristic X-ray is performed for each of these elements. The map data is subjected to line analysis for the distribution of component concentrations.

A material powder for a heating member was prepared in the following manner. 85% by weight silicon nitride material powder having an average particle size of 1.0 μm and, as sintering aid powders, 10% by weight $Yb_2O_3$ powder and 5% by weight $SiO_2$ powder were mixed, thereby yielding an insulative component material. 45% by weight insulative component material and 55% by weight WC powder were wet-mixed for 24 hours in a ball mill, followed by drying to thereby obtain a powder mixture. To the resulting powder mixture, a binder was added in a predetermined amount. The resulting mixture was placed in a kneader and then kneaded for four hours. The resultant kneaded substance was cut into pellets. The thus-obtained pellets were charged into an injection molding machine equipped with the mold 31 (see FIG. 3), thereby yielding molded articles (unitary green bodies) 35, which are to become U-shaped conductors each having tungsten lead wires joined to opposite ends thereof.

A material powder for a ceramic substrate was prepared in the following manner. 83% by weight silicon nitride material powder having an average particle size of 0.6 μm and, as sintering aid powders, 10% by weight $Yb_2O_3$ powder, 5% by weight $SiO_2$ powder, and 2% by weight $MoSi_2$ powder were mixed. The resultant mixture and a binder were wet-mixed for 20 hours. The resultant mixture was spray-dried, thereby yielding a powder. The thus-obtained powder was compacted into the two half green bodies 36 and 37 shown in FIG. 4. Subsequently, each of the unitary green bodies 35 obtained as above was sandwiched between the half green bodies 36 and 37. The resultant assembly was pressed into the composite green body 39 shown in FIG. 5(*a*) and FIG. 6(*a*).

Next, the composite green bodies 39 were debindered (preliminarily fired), thereby yielding debindered bodies (preliminarily fired bodies) 39' (see FIG. 6). Next, a parting agent such as BN was applied onto the preliminarily fired bodies 39'. The resultant preliminarily fired bodies 39' were fired by hot pressing in the kiln 64 by use of the hot-pressing dies (firing jigs) 65 shown in FIG. 5(*b*). Firing conditions were as follows: nitrogen atmosphere, 1800° C., 20 kg/cm$^2$, 60 minutes. The thus-fired articles were polished, thereby yielding the ceramic heaters 1 shown in FIG. 2. By using the ceramic heaters 1, the glow plugs 50 shown in FIG. 1 were manufactured.

The thus-obtained ceramic heaters 1 were subjected to the flexural strength test of JIS R1601 (1981) to measure flexural strength (3-point bending strength) (MPa). The surfaces of the ceramic heaters 1 were analyzed by X-ray diffraction to determine whether or not the melilite crystal phase is present. Each of the glow plugs was subjected to an active durability test in which electricity was applied to the ceramic heater 1 from a DC power supply for one minute in order to rapidly heat the ceramic heater 1 to a temperature of 1000° C., and then application of electricity was halted for one minute while air was being blown to the glow plug for forced cooling, to thereby make one cycle of test operation. Each of the glow plugs was subjected to up to 10,000 cycles of test operation to check whether or not the ceramic heater cracks.

The cracking occurrence rate (cracking rate) of the hot-pressing dies (firing jigs) 65 in the course of firing was calculated by (number of cracked jigs)/((number of jigs used in a single hot press firing process)×(firing count))×100 (%). The firing count was 100 . Also, the ultimate firing count for repeated use was measured for the hot-pressing dies (firing jigs) 65 which were sound after having been fired 100 times.

The above firing test used various kinds of hot-pressing dies (firing jigs) 65 which are classified, as shown in Table 1, according to a method for forming silicon carbide in a surface layer portion extending along the surface of the cavities 65*a*. Specifically, in Examples 1 and 2, ceramic heaters were manufactured by use of the firing jigs which had been manufactured from carbon jigs made of graphite, by hot-pressing a silicon nitride composition (a composition for forming silicon carbide) at 1300° C. or 1600° C. by use of the carbon jigs, to thereby form silicon carbide in a surface layer portion of each of the carbon jigs. In Examples 3 to 6, ceramic heaters were manufactured by use of the firing jigs which had been manufactured from carbon jigs made of graphite, by applying a slurry made from a silicon carbide powder or silicon powder onto the surface of cavities of the carbon jigs, followed by heating to a predetermined temperature, to thereby form silicon carbide in a surface layer portion of each of the carbon jigs. In Examples 7 and 8, ceramic heaters were manufactured by use of the firing jigs which had been manufactured from carbon jigs made of graphite, by covering the surface of cavities of the carbon jigs with a $Si_3N_4$ powder, followed by heating to a predetermined temperature, to thereby form silicon carbide in a surface layer portion of each of the carbon jigs. In Example 9, ceramic heaters were manufactured by use of the firing jigs formed from a sintered body of silicon carbide.

In Comparative Example 1, ceramic heaters were manufactured by use of carbon jigs made of graphite. In Comparative Example 2, ceramic heaters were manufactured by use of the firing jigs which had been manufactured from carbon jigs by hot-pressing a silicon nitride composition (a composition for forming silicon carbide) at 1200° C. by use of the carbon jigs. In Comparative Example 3, ceramic heaters were manufactured by use of the firing jigs which had been manufactured from carbon jigs by applying a slurry made from a silicon carbide powder onto the surface of cavities of the carbon jigs, followed by heating to 1400° C. In Comparative Example 4, ceramic heaters were manufactured by use of the firing jigs which had been manufactured from carbon jigs by covering the surface of cavities of the carbon jigs with an $Si_3N_4$ powder, followed by heating to 1400° C. The firing jigs which had been manufactured from carbon jigs by subjecting the carbon jigs to the above-described treatments were measured for the depth of a formed SiC—C composite layer from the cavity surface by the aforementioned EPMA. The test results are shown in Table 1

TABLE 1

| | | SiC-C | Ceramic heater performance | | | Crack/ablation of jig | |
|---|---|---|---|---|---|---|---|
| Example | SiC formation process | composite layer thickness (mm) | Flexural strength (MPa) | Melilite crystal phase | Active-durability test result 1000° C., 1 min, ON-OFF | Jig cracking rate in firing (%) | Ultimate firing count for repeated use of sound jig after firing test |
| 1 | Hot pressing silicon nitride at 1300° C. | 2.1 | 1310 | Absent | Sound after 10000 cycles | 1.0% | 25 |
| 2 | Hot pressing silicon nitride at 1600° C. | 5.3 | 1330 | Absent | Sound after 10000 cycles | 0.5% | 28 |
| 3 | Applying SiC slurry, followed by heating to 1500° C. | 1.2 | 1280 | Absent | Sound after 10000 cycles | 2.0% | 35 |
| 4 | Applying SiC slurry, followed by heating to 1800° C. | 6.7 | 1300 | Absent | Sound after 10000 cycles | 0.5% | 42 |
| 5 | Applying Si slurry, followed by heating to 1500° C. | 0.7 | 1320 | Absent | Sound after 10000 cycles | 2.0% | 34 |
| 6 | Applying Si slurry, followed by heating to 1800° C. | 3.5 | 1270 | Absent | Sound after 10000 cycles | 1.0% | 38 |
| 7 | Covering with $Si_3N_4$ powder, followed by heating to 1600° C. | 0.8 | 1300 | Absent | Sound after 10000 cycles | 2.0% | 28 |
| 8 | Covering with $Si_3N_4$ powder, followed by heating to 1800° C. | 4.2 | 1350 | Absent | Sound after 10000 cycles | 0.5% | 33 |
| 9 | SiC sintered jig | All SiC | 1320 | Absent | Sound after 10000 cycles | 2.0% | 39 |

TABLE 1-continued

| Example | SiC formation process | SiC-C composite layer thickness (mm) | Ceramic heater performance: Flexural strength (MPa) | Ceramic heater performance: Melilite crystal phase | Ceramic heater performance: Active-durability test result 1000° C., 1 min, ON-OFF | Crack/ablation of jig: Jig cracking rate in firing (%) | Crack/ablation of jig: Ultimate firing count for repeated use of sound jig after firing test |
|---|---|---|---|---|---|---|---|
| Comp. Ex. 1 | SiC not formed (carbon jig) | 0 | 860 | Present | Cracking at 800 cycles | 12.0% | 8 |
| Comp. Ex. 2 | Hot pressing silicon nitride at 1200° C. | 0.3 | 1140 | Present | Cracking at 3500 cycles | 5.0% | 8 |
| Comp. Ex. 3 | Applying SiC slurry, followed by heating to 1400° C. | 0.2 | 1080 | Present | Cracking at 2000 cycles | 8.0% | 13 |
| Comp. Ex. 4 | Covering with $Si_3N_4$ powder, followed by heating to 1400° C. | 0.1 | 900 | Present | Cracking at 1500 cycles | 8.0% | 10 |

As shown in Table 1, in the case of carbon firing jigs in which silicon carbide is formed under the conditions of Examples 1–8, the SiC—C composite layer thus formed extends from the cavity surface to a depth of about 0.7–6.7 mm. SiC—C composite layers formed in the corresponding firing jigs of Examples 1–8 and Example 9 are thicker than those formed in the corresponding firing jigs of Comparative Examples 1–4 (in the case of Examples, the thickness of the composite layers is not less than 0.5 mm). The ceramic heaters of Examples 1–9 exhibit better performance in terms of flexural strength and active durability than those of Comparative Examples 1–4. Also, the ceramic heaters of Examples 1–9 show absence of the melilite crystal phase in a surface portion of the ceramic substrate. The firing jigs of Examples 1–9 exhibit a low cracking rate of 0.5–2.0% and a high ultimate firing count for repeated use of 25–42, indicating higher durability as compared with those of Comparative Examples 1–4.

Herein, the term "main component" or the component appearing in the expression "formed essentially of a component" means a component whose content by weight is the highest among components, unless specified otherwise.

It should further be apparent to those skilled in the art that various changes in form and detail of the invention as shown and described above may be made. It is intended that such changes be included within the spirit and scope of the claims appended hereto.

This application is based on Japanese Patent Application No. 2001-229215 filed Jul. 30, 2001, incorporated herein by reference in its entirety.

What is claimed is:

1. A method for manufacturing a glow plug ceramic heater comprising a silicon nitride ceramic substrate and a resistance-heating member embedded in the silicon nitride ceramic substrate, characterized in that the silicon nitride ceramic substrate contains oxygen at an average concentration in the range of from 0.4 to 3.2% by weight in a surface layer portion extending from a surface thereof to a depth of 1 mm, which method comprises:

firing a green body or a preliminarily fired body which is to become the silicon nitride ceramic substrate, through hot pressing by use of a firing jig; and wherein:

the firing jig has a plurality of curved cavities, each for accommodating such a green body or preliminarily fired body, and comprises a SiC—C composite in a surface layer portion extending from a surface of the cavities to a depth of at least 0.5 mm.

2. The method as claimed in claim 1 for manufacturing a ceramic heater, wherein a carbon jig having the plurality of cavities and formed essentially of carbon is used as the firing jig, and a surface layer portion of the carbon jig extending from a surface of the cavities to a depth of at least 0.5 mm comprises a SiC—C composite produced by placing in each of the cavities a green body or preliminarily fired body formed essentially of a silicon compound or silicon, followed by firing through hot pressing at a temperature not lower than 130° C.

3. The method as claimed in claim 1 for manufacturing a ceramic heater, wherein a carbon jig having the plurality of cavities and formed essentially of carbon is used as the firing jig, and a surface layer portion of the carbon jig extending from a surface of the cavities to a depth of at least 0.5 mm comprises a SiC—C composite produced by applying a composition consisting essentially of a silicon compound or silicon to at least a surface of the cavities or by coating at least the surface with the composition, followed by heating at a temperature not lower than 1500° C.

4. A glow plug ceramic heater comprising a silicon nitride ceramic substrate and a resistance-heating member embedded in the silicon nitride ceramic substrate, characterized in that the silicon nitride ceramic substrate contains oxygen at an average concentration in the range of from 0.4 to 3.2% by weight in a surface layer portion extending from a surface thereof to a depth of 1 mm, which glow plug ceramic heater is prepared by:

firing a green body or a preliminarily fired body which is to become the silicon nitride ceramic substrate, through hot pressing by use of a firing jig; and wherein:

the firing jig has a plurality of curved cavities, each for accommodating such a green body or preliminarily fired body, and comprises a SiC—C composite in a surface layer portion extending from a surface of the cavities to a depth of at least 0.5 mm.

5. The glow plug ceramic heater as claimed in claim 4, wherein a carbon jig having the plurality of cavities and formed essentially of carbon is used as the firing jig, and a surface layer portion of the carbon jig extending from a surface of the cavities to a depth of at least 0.5 mm comprises a SiC—C composite produced by placing in each of the cavities a green body or preliminarily fired body formed essentially of a silicon compound or silicon, followed by firing through hot pressing at a temperature not lower than 1300° C.

6. The glow plug ceramic heater as claimed in claim 4, wherein a carbon jig having the plurality of cavities and formed essentially of carbon is used as the firing jig, and a surface layer portion of the carbon jig extending from a surface of the cavities to a depth of at least 0.5 mm comprises a SiC—C composite produced by applying a composition consisting essentially of a silicon compound or silicon to at least a surface of the cavities or by coating at least the surface with the composition, followed by heating at a temperature not lower than 1500° C.

7. A method for manufacturing a glow plug ceramic heater comprising a silicon nitride ceramic substrate and a resistance-heating member embedded in the silicon nitride ceramic substrate, characterized in that the silicon nitride ceramic substrate contains oxygen at an average concentration in the range of from 0.4 to 3.2% by weight in a surface layer portion extending from a surface thereof to a depth of 1 mm, which method comprises:

firing a green body or a preliminarily fired body which is to become the silicon nitride ceramic substrate, through hot pressing by use of a firing jig; and wherein:

the firing jig has a plurality of curved cavities, each for accommodating such a green body or preliminarily fired body, and is formed essentially of silicon carbide in a surface layer portion extending from a surface of the cavities to a depth of at least 0.5 mm.

8. The method as claimed in claim 7 for manufacturing a ceramic heater, wherein a carbon jig having the plurality of cavities and formed essentially of carbon is used as the firing jig, and a surface layer portion of the carbon jig extending from a surface of the cavities to a depth of at least 0.5 mm is formed essentially of silicon carbide produced by placing in each of the cavities a green body or preliminarily fired body formed essentially of a silicon compound or silicon, followed by firing through hot pressing at a temperature not lower than 1300° C.

9. The method as claimed in claim 7 for manufacturing a ceramic heater, wherein a carbon jig having the plurality of cavities and formed essentially of carbon is used as the firing jig, and a surface layer portion of the carbon jig extending from a surface of the cavities to a depth of at least 0.5 mm is formed essentially of silicon carbide produced by applying a composition consisting essentially of a silicon compound or silicon to at least a surface of the cavities or by coating at least the surface with the composition, followed by heating at a temperature not lower than 1500° C.

10. A glow plug ceramic heater comprising a silicon nitride ceramic substrate and a resistance-heating member embedded in the silicon nitride ceramic substrate, characterized in that the silicon nitride ceramic substrate contains oxygen at an average concentration in the range of from 0.4 to 3.2% by weight in a surface layer portion extending from a surface thereof to a depth of 1 mm, which glow plug ceramic heater is prepared by:

firing a green body or a preliminarily fired body which is to become the silicon nitride ceramic substrate, through hot pressing by use of a firing jig; and wherein:

the firing jig has a plurality of curved cavities, each for accommodating such a green body or preliminarily fired body, and is formed essentially of silicon carbide in a surface layer portion extending from a surface of the cavities to a depth of at least 0.5 mm.

11. The glow plug ceramic heater as claimed in claim 10, wherein a carbon jig having the plurality of cavities and formed essentially of carbon is used as the firing jig, and a surface layer portion of the carbon jig extending from a surface of the cavities to a depth of at least 0.5 mm is formed essentially of silicon carbide produced by placing in each of the cavities a green body or preliminarily fired body formed essentially of a silicon compound or silicon, followed by firing through hot pressing at a temperature not lower than 1300° C.

12. The glow plug ceramic heater as claimed in claim 10, wherein a carbon jig having the plurality of cavities and formed essentially of carbon is used as the firing jig, and a surface layer portion of the carbon jig extending from a surface of the cavities to a depth of at least 0.5 mm is formed essentially of silicon carbide produced by applying a composition consisting essentially of a silicon compound or silicon to at least a surface of the cavities or by coating at least the surface with the composition, followed by heating at a temperature not lower than 1500° C.

* * * * *